US006582071B1

(12) United States Patent
Belbey

(10) Patent No.: US 6,582,071 B1
(45) Date of Patent: Jun. 24, 2003

(54) APPARATUS AND METHOD OF SUPPORTING MEDIA IN AN IMAGE TRANSFER SYSTEM

(75) Inventor: Jason S. Belbey, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/150,365

(22) Filed: May 17, 2002

(51) Int. Cl.[7] ..... B41J 2/01
(52) U.S. Cl. ..... 347/103
(58) Field of Search ..... 347/103, 120, 347/20, 123, 111, 159, 141, 155, 127, 128, 17, 154, 56, 61, 63, 65, 67; 399/271, 290, 292, 293, 294, 33, 67, 320

(56) References Cited

U.S. PATENT DOCUMENTS 6,464,342 B1 * 10/2002 Kubota et al. ..... 347/56

* cited by examiner

*Primary Examiner*—Raquel Yvette Gordon

(57) ABSTRACT

An image transfer system, including a member for supporting print media, the member including a pair of sidewalls depending therefrom, a pair of end caps, wherein one end cap is connected to the sidewalls at an end thereof and the other end cap is connected to the opposite end of the sidewalls, and a heating element disposed against the underside of the member and in contact with each of sidewalls and end caps.

42 Claims, 5 Drawing Sheets

APPARATUS AND METHOD OF SUPPORTING MEDIA IN AN IMAGE TRANSFER SYSTEM

BACKGROUND

In the ink jet printing process, suitable support of the print media during printing aids in achieving acceptable print quality. Such support can include holding sheet media flat against a media supporting member, or platen, to ensure the ink maintains suitable properties during printing.

In addition, it may be desirable that a media sheet be heated uniformly as it rests on the printer platen, in order to achieve acceptable print quality. A technique, in pursuit of this goal, is to heat the platen to a suitable temperature. This is sometimes accomplished by the use of heating strips disposed against the sidewalls of the platen. While this technique results in effective heating of areas of the platen surface, it can fail in some instances to provide uniform heating over the platen surface. The result can be a diminution in print quality because of temperature gradients across the platen producing unevenly heated media sheets.

Where the term "image transfer system" is used in this description, the term is meant to encompass a variety of such devices, including printers, facsimile devices and scanners. For convenience, the term "printer" will be used in this written description but it should be understood that the description is intended broadly, to cover such other devices.

Another factor adversely affecting print quality may be a failure to draw the media sheet against the platen in a uniform manner. This is especially the case at the ends of the platen where air passes under media edges, thereby tending to raise the media away from the platen Airflow at the media edges allows cool air to pass under the edges as the air flows generally toward the center of the media for evacuation. This airflow can produce an uneven temperature distribution across the media as portions of the media are raised away from the heated platen. Again, the result adversely impacts print quality. In addition, if air flows freely under media edges, a potential develops whereby the edges lifting from the platen surface may contact printheads thereby causing print defects, paper jams and, in some cases, damage to the printer.

SUMMARY OF THE INVENTION

An image transfer system includes a member for supporting print media, the member including a pair of sidewalls depending therefrom, a pair of end caps, wherein one end cap is connected to the sidewalls at an end thereof and the other end cap is connected to the opposite end of the sidewalls, and a heating element disposed against the underside of the member and in contact with each of sidewalls and end caps.

BRIEF DESCRIPTION OF DRAWINGS

Embodiments of the present invention will become apparent from the following detailed description, taken in conjunction with the accompanying drawings, illustrating by way of example the principles thereof.

DETAILED DESCRIPTION

Figure 1:
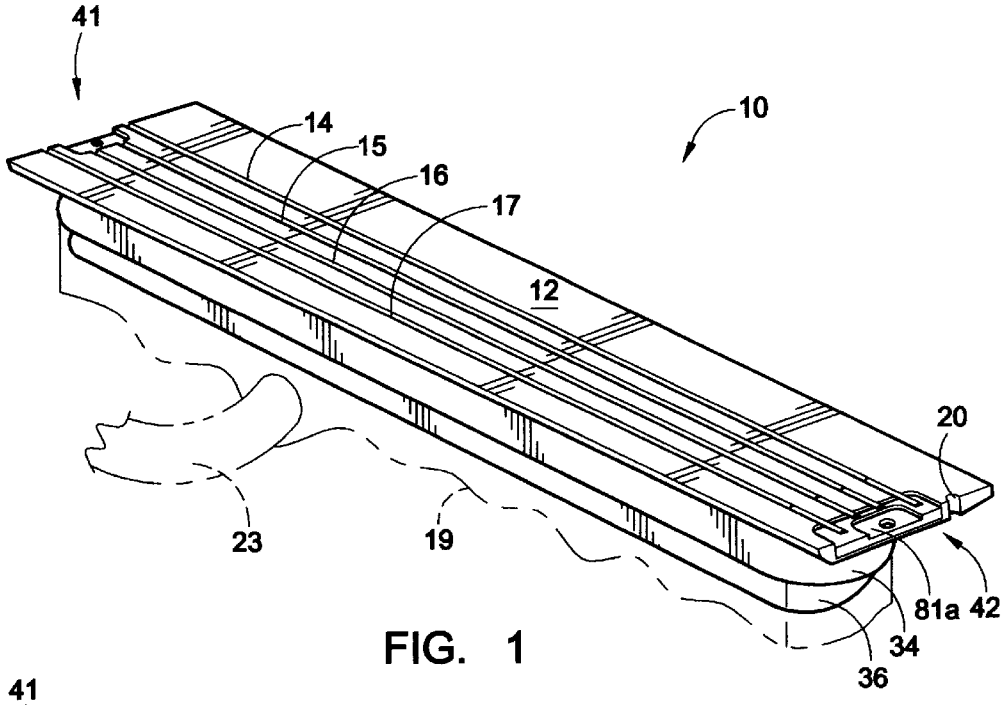
FIG. 1 is a perspective view of a platen that is constructed according to an embodiment of the present invention.

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes that come within the meaning and range of equivalency of the claims are to be embraced within their scope.

In the following detailed description and in the several figures of the drawings, like elements are identified with like reference numerals.

Referring now to the drawings and in particular to FIGS. 1–5, there is shown a member or platen, generally referred to by the reference numeral 10, that is constructed according to an embodiment of the present invention. The platen 10 is of elongated rectangular shape having a planar top surface 12 that, during a printing process, supports a media sheet, such as the sheet 45, shown in FIGS. 6 and 12. A plurality of substantially parallel, spaced apart grooves 14–17 is disposed on the platen top surface 12, between a platen left side, generally indicated by the reference numeral 41, and a platen right side, generally indicated by the reference numeral 42.

A pair of sidewalls 13 and 18 is integrally connected with, and depends from, a bottom surface 11 of the platen 10. End caps 31 and 32 are disposed on the right side 42, and the left side 41, of the platen 10.

The end caps 31 and 32 are in intimate contact with the ends of the sidewalls 13 and 18 at end cap flat inner surfaces 33 and 35. They are in intimate contact, also, with the bottom surface 11 of the platen 10. The sidewalls 13 and 18, end caps 31 and 32, and the platen bottom surface 11 form five sides of a box, generally referred to by the reference numeral 21.

Figure 2:
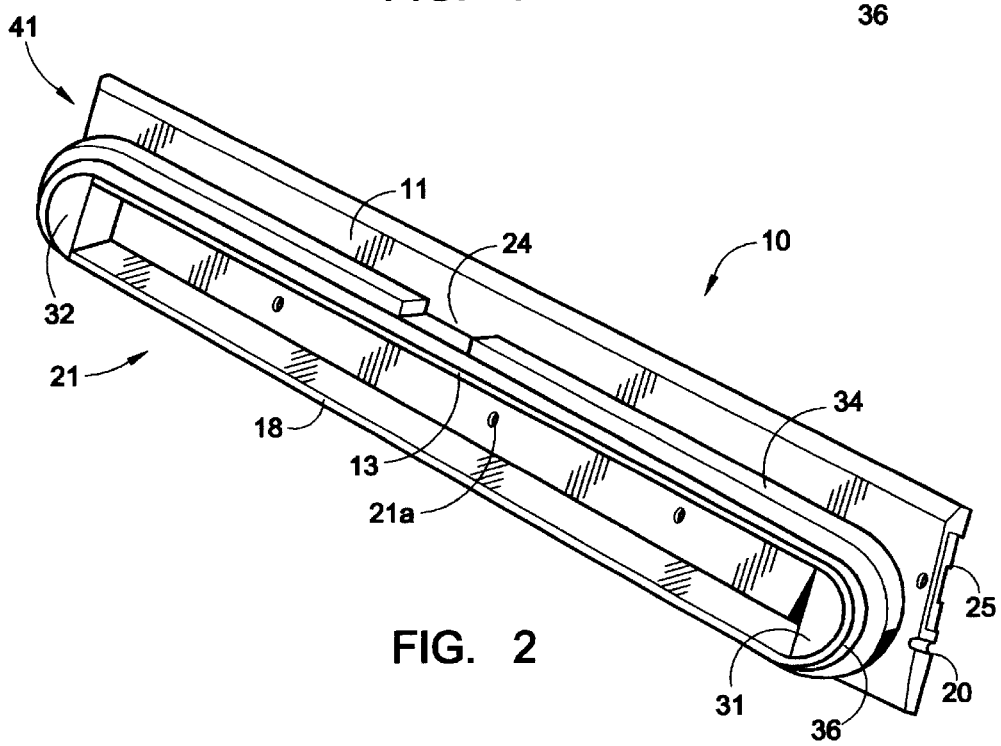
FIG. 2 is a perspective view of the platen of FIG. 1 showing the underside thereof.
Figure 3:
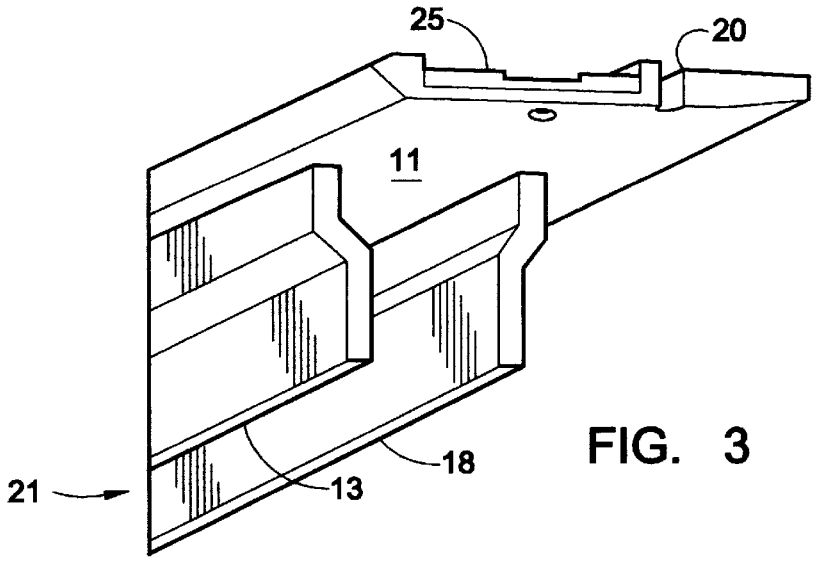
FIG. 3 is a partial view of the left side of platen of FIG. 1.
Figure 4:
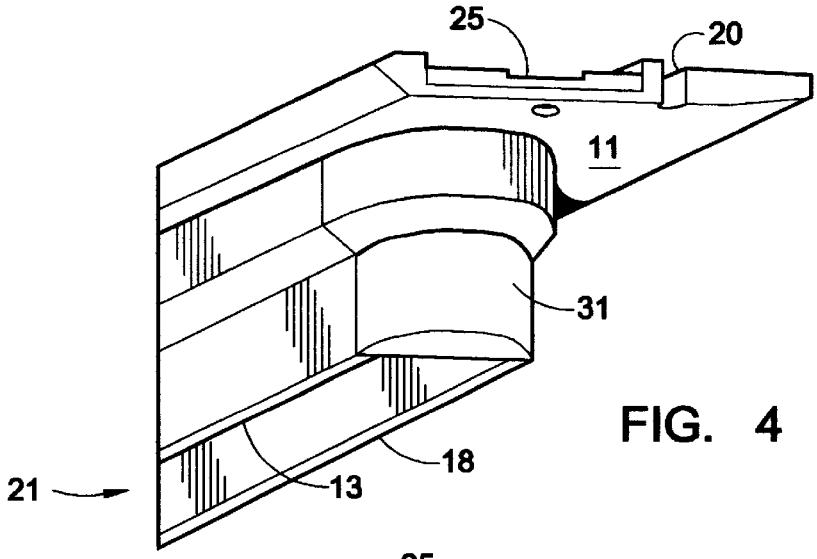
FIG. 4 is a partial of the left side of the platen of FIG. 1 showing end caps.

It will be noted, with reference to FIGS. 1 and 2, that a vacuum box 19 is located under the platen 10. It contacts the sidewalls 13 and 18 and the end caps 31 and 32. A continuous elastomeric seal 36 seals the sidewalls and end caps 31 and 32 at arcuate outer surfaces 33*a* and 35*a* to ensure a leak tight configuration. It will be noted, with reference to FIG. 4, that each of the end caps 31 and 32 includes an upper portion 30 and a lower portion 30*a*, as shown in FIG. 4, with respect to the end cap 31.

During printing, air is evacuated from the grooves 14–17. The air flows through apertures or openings in the platen 10, such as the opening 21*a*, from whence the air is pumped via a J-tube 23 out of the vacuum box 21. The J-tube is sealingly connected to the sidewall of the vacuum box 19 at a medial opening 24 thereof.

Figure 5:
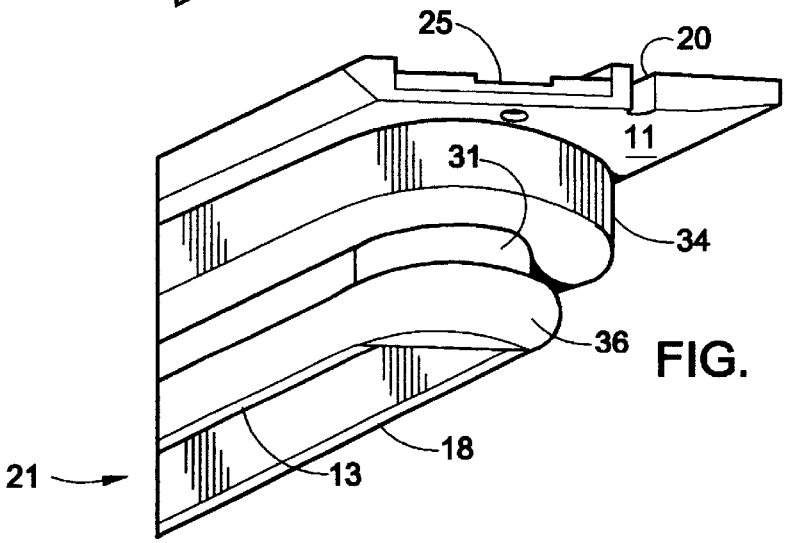
FIG. 5 is a partial view of the left side of platen of FIG. 1 showing the end caps, a heating element and an elastomeric seal.
Figure 6:
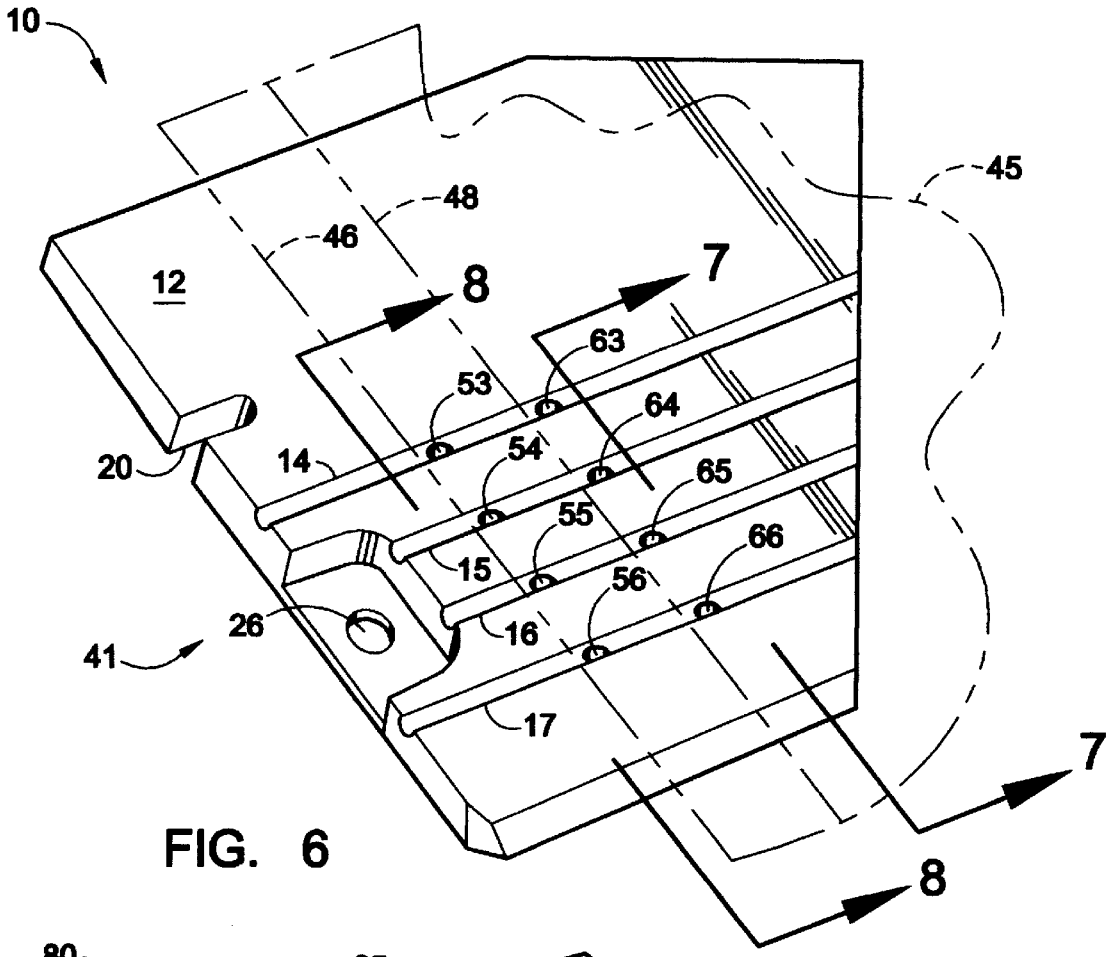
FIG. 6 is a partial view of the left side of platen of FIG. 1 showing a portion of the surface thereof.

As best shown in FIGS. 1, 2 and 5, a heating element, or heater 34, is disposed in intimate contact with the bottom surface 11 of platen 10, the sidewalls 13 and 18 and the end caps 31 and 32. The heater 34 imparts heat to the platen 10 along a continuous strip to provide improved uniformity of heating to the platen. In this manner, the platen ends 41 and 42 are maintained at substantially the same temperature as the central portion of the platen 10, thereby ensuring that media disposed on the platen are heated more evenly. Platens, without the heat-conducting end caps 31 and 32 of the present embodiment of the invention, may be heated in a non-uniform manner so that media edges are cooler than the center of the media.

In an advantage provided by the present embodiment, not only do the end caps 31 and 32 improve print quality, they enable the platen 10 and the dependent sidewalls 13 and 18 to be extruded in one piece. As a result, a less expensive platen can be formed. The platen top surface 12 includes a datum 20 for helping to locate the platen 10 in a printer (not shown). In a preferred embodiment of the invention, to ensure good heat conduction to the platen edges 41 and 42, the end caps 31 and 32 may be constructed of copper alloy, aluminum or composites containing carbon fibers, with copper alloy presently preferred.

As mentioned above, it is advantageous during printing for at least some types of print media to be heated to enable the ink to maintain good properties during printing. In this regard, it is desirable to prevent air from outside the platen 10 edges to flow under the media sheet during printing. FIGS. 6–12 depict the structure and function of two types of vacuum plugs. First considered will be vacuum plugs 70 and 70*a*.

Figure 9:
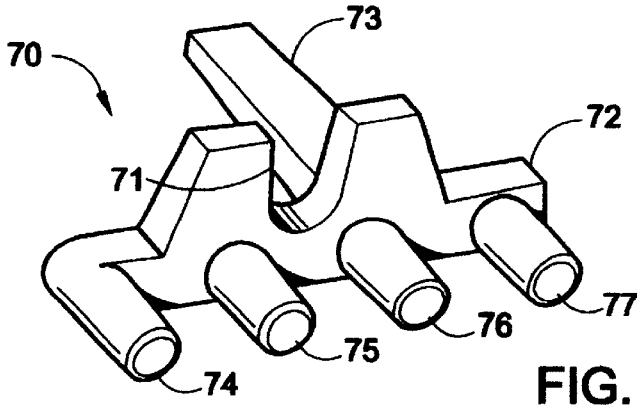
FIG. 9 is a perspective view of a vacuum plug that is constructed according to the embodiment of the present invention.

With reference to FIG. 9, the vacuum plug 70 includes a member or body 72 having a handle 73 extending from a back thereof and tines 74–77 extending from the body 72, opposite the handle 73. A mounting slot 71 is formed in the body 72. It will be understood that the vacuum plug 70*a* is identical to the plug 70 in structure and function, having identical elements. As these elements appear in FIG. 10, their reference numerals are identical to counterparts in the plug 70, except the numerals having the lower case "a" following the numeral.

The vacuum plugs 70 and 70*a* prevent air from flowing from the left side 41 of the platen 10 and under the media as the media are receiving ink. In accomplishing this, the vacuum plugs 70 and 70*a* function as bottom-insert plugs to block edge-to-edge airflow through the grooves 14–17. This function can be understood by referring to FIG. 6 where there is shown a partial view of the left side 41 of the platen 10. The print media sheet 45, shown in phantom, has an edge 46, and in a narrower version, an edge 48. It will be noted that openings 53–56 are formed in the grooves 17, 16, 15 and 14, respectively.

The openings 53–56 extend through the platen 10 and they are aligned adjacent the edge of the media sheet 46 in a line perpendicular to the axes of the grooves 14–16. In a similar manner, openings 63–66 are formed in the grooves 17, 16, 15, and 14, respectively, and are disposed adjacent the end of the media sheet 48. The openings 63–66 are aligned parallel to their counterpart openings 53–56.

Figure 10:
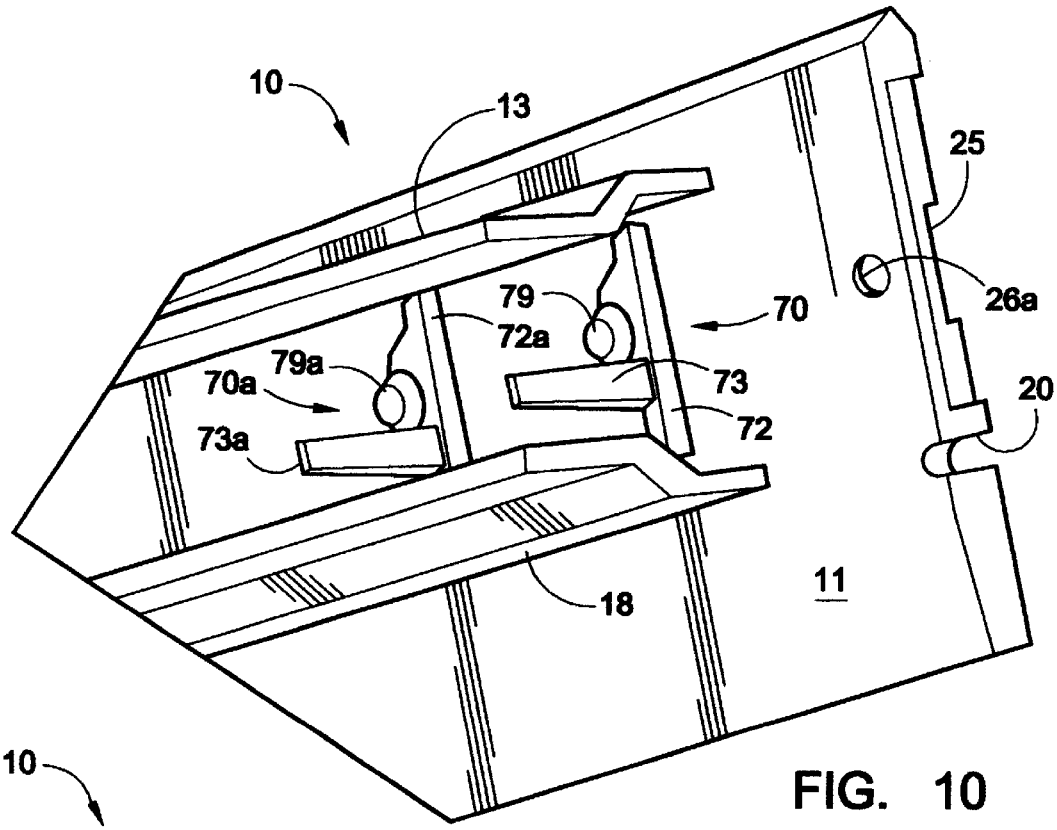
FIG. 10 is a partial view of the underside of platen of FIG. 1, showing the vacuum plug of FIG. 9 in place.
Figure 7:
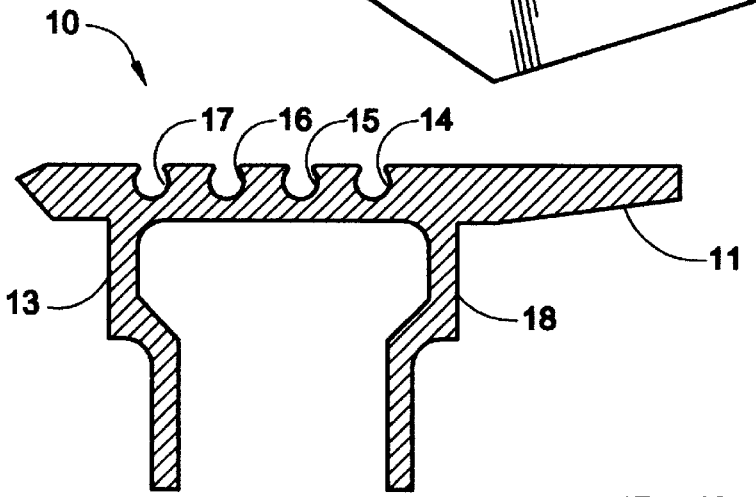
FIG. 7 is a view taken along the line 7—7 of FIG. 6.
Figure 8:
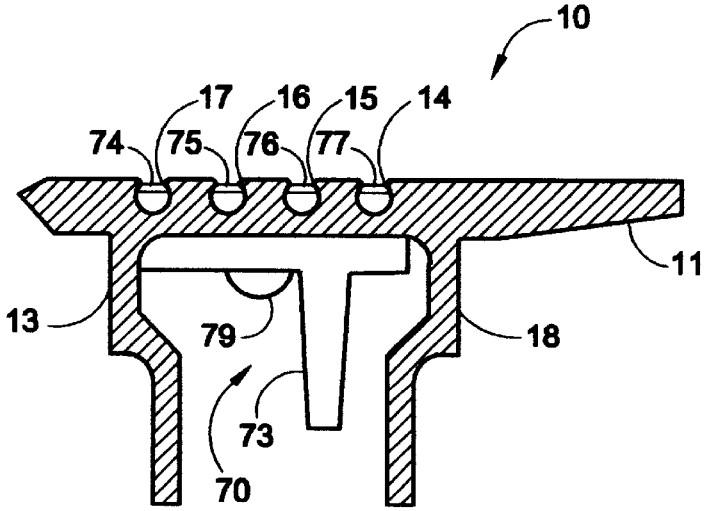
FIG. 8 is a view taken along the line 8—8 of FIG. 6.

The function of the openings 53–56 and 63–66, and their relationships to the plugs 70 and 70*a*, will be understood by reference to FIGS. 7, 8 and 10. The sectional view of FIG. 7 shows the grooves in an unblocked condition. On the other hand, the sectional view of FIG. 8, taken along a line outside the margin 46 of the sheet 45, shows the vacuum plug 70 in place and having the tines 77, 76, 75 and 74 extending into the grooves 14–17, and openings 53–56, respectively.

The method of attachment of the plug 70 is shown in FIG. 10 where it will be seen that a fastener, such as a screw 79, is utilized to secure the plug 70 to the bottom side 11 of the platen 10. In a similar manner, the vacuum plug 70*a* is attached to the bottom side 11 by a fastener, or screw 79*a*. By referring to FIG. 6, it will be understood that the tines of the vacuum plug extend into, and obstruct airflow through the openings 53–56 or 63–66.

It will be noted that since the openings 53–56 are just within the margin 46 of the sheet 45, and the openings 63–66 are just within the margin 48, the use of the vacuum plugs 70 and 70*a* provides a passive, capacity of system adjustment.

Figure 11:
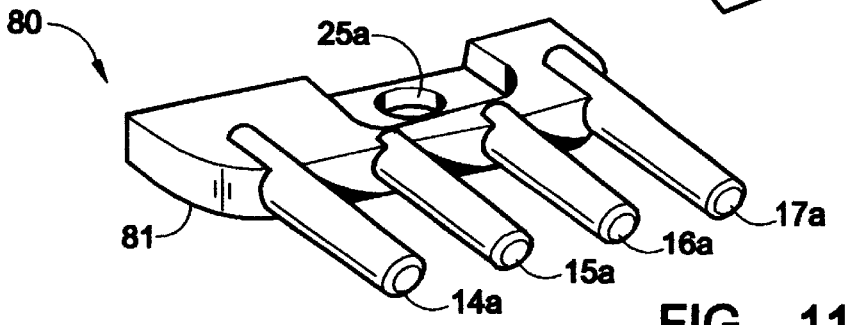
FIG. 11 is a perspective view of another embodiment of a vacuum plug that is constructed according to an embodiment of the present invention.
Figure 12:
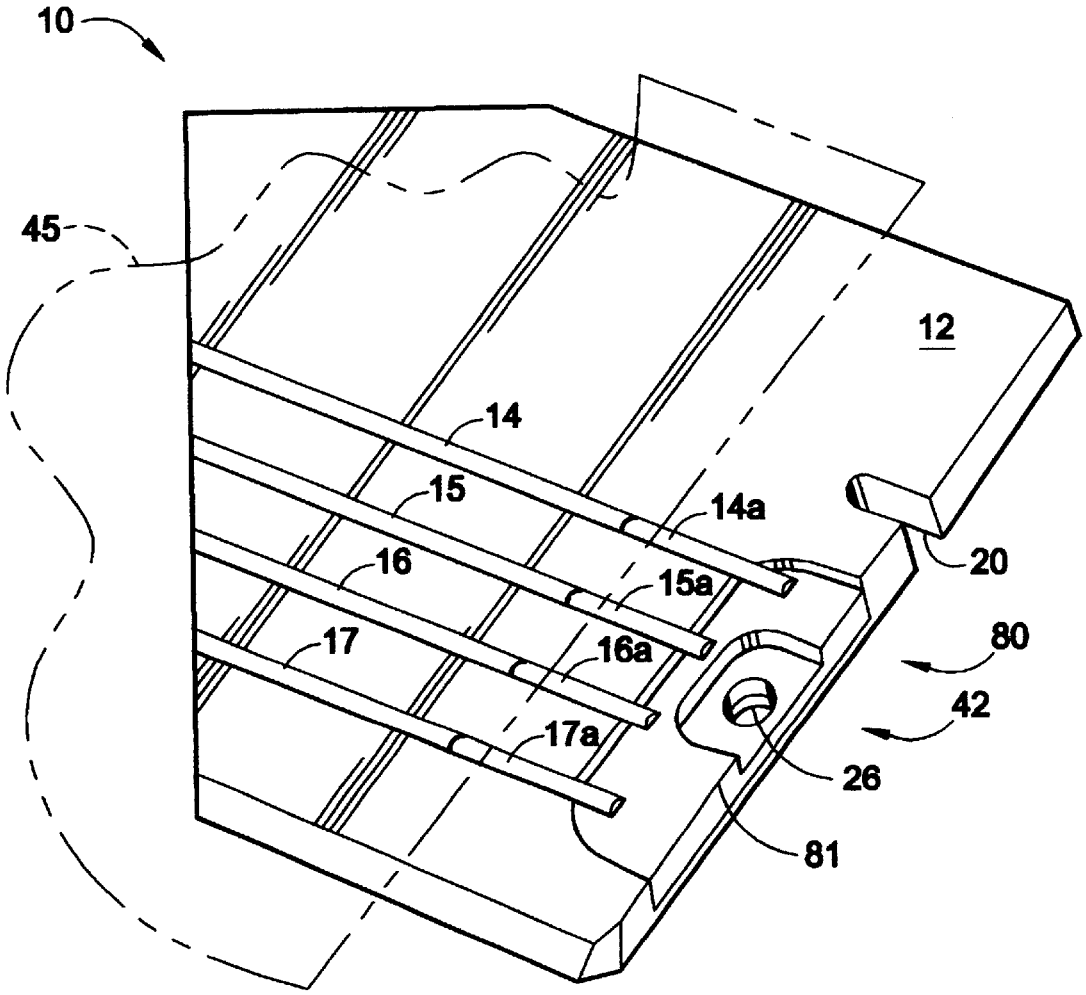
FIG. 12 is a partial view of the right side of the platen of FIG. 1 showing the vacuum plug of FIG. 11 in place.

With reference now to FIGS. 11 and 12, the airflow blocking function of the vacuum plug 80 will be discussed. The plug 80 includes a body 81 from which extend tines 14*a*–17*a*. An opening 25*a* corresponds to an opening 26 in the platen 10 to enable installation of the vacuum plug 80. FIG. 12 shows the right side edge 42 of the platen 10. Here, the media sheet 45 is depicted in the justified condition, on the right side of the platen 10. The plug 80 is installed in the platen 10 so that the plug body 81 fits in a recess 25 and the tines 14*a*–17*a* extend, respectively, into the grooves 14–17 to block airflow from the right side edge 42 medially toward the center of the platen 10.

In summary, the vacuum plug 80 functions as a side-inserted vacuum plug to block edge-to-edge airflow on the justified side 42 (right side) of the platen 10.

It will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. An image transfer system, comprising:

a member for supporting media, said member including a pair of sidewalls depending therefrom;

a pair of end caps, wherein one end cap is connected to the sidewalls at an end thereof and the other end cap is connected to the opposite end of the sidewalls; and a heating element disposed against the underside of said member and in contact with each of said sidewalls and said end caps.

2. The system according to claim 1, wherein said member is a platen including an elongated configuration.

3. The system according to claim 1, wherein said end caps are composed of thermally conductive material.

4. The system according to claim 1, wherein said end caps are selected from the group consisting of copper alloy, aluminum and composites containing carbon fibers.

5. The system according to claim 1, wherein each one of said end caps includes a generally flat inner surface, for contacting said sidewalls, and an arcuate shaped outer surface.

6. The system according to claim 5, wherein each one of said end caps includes an upper portion and a dependent lower portion and said lower portion is narrower than said portion in the distance from said inner surface to said arcuate shaped outer surface.

7. A method of heating media in an image transfer system, comprising:

providing a member for supporting said media, said member including a pair of sidewalls depending therefrom;

connecting an end cap to the sidewalls at each of the ends thereof; and fixing a heating element against the underside of said member and against each of said sidewalls and said end caps.

8. The method according to claim 7, including heating said element to thereby heat said member.

9. The method according to claim 7, including forming said end caps from a composition selected from the group consisting of copper alloy, aluminum and composites containing carbon fibers.

10. An image transfer system, comprising:

means for drawing media against a member having a surface for supporting said media, said member including a plurality of spaced apart grooves, wherein said grooves are disposed substantially on said member surface;

means for evacuating air from said grooves thereby to hold said media against said member surface; and means disposed at one end of said member for preventing air flow into said grooves at an edge of said member defined by said member end.

11. The system according to claim 10, wherein said spaced apart grooves are substantially parallel.

12. The system according to claim 10, wherein said one end of said member includes a recess for receipt therein of a portion of said preventing means.

13. The system according to claim 10, wherein said preventing means includes a body member and a plurality of tines projecting from said body member wherein said body member fits into said member recess and said tines fit into said grooves to prevent airflow into said grooves from the edge of said member.

14. An image transfer system, comprising:

a platen having a surface for supporting media;

means for drawing media against said platen surface wherein said platen includes a surface for supporting media, said platen further including a plurality of spaced apart grooves, wherein said grooves are disposed substantially the length of said platen;

means for evacuating air from said grooves thereby to hold said media against said platen surface; and means disposed intermediate the ends of said platen for preventing airflow into said grooves from an edge of said platen.

15. The system according to claim 14, wherein said spaced apart grooves are substantially parallel.

16. The system according to claim 14, wherein each one of said grooves includes a first and a second opening through the bottom of each of said grooves and through said platen and said first openings are aligned in a row perpendicular to said grooves and said second openings are aligned in a row parallel to said first openings row.

17. The system according to claim 14, wherein said first row helps to define on said platen an edge of a first media sheet having a width and said second row helps to define on said platen an edge of a second media sheet having a width greater than that of said first media sheet.

18. The system according to claim 14, wherein said means for preventing airflow includes a plug having a body member and a plurality of tines whereby said plug is attached to the underside of said platen and said tines extend into the aligned first openings in said grooves to prevent airflow from an edge of said platen into said grooves.

19. The system according to claim 14, wherein said means for preventing airflow further includes a plug having a body member and a plurality of tines whereby said plug is attached to the underside of said platen and said tines extend into the aligned second openings in said grooves to prevent airflow from an edge of said platen into said grooves from an area located between said first plugged openings and said second openings.

20. A method of drawing media against a member, comprising:

providing a platen having a surface for supporting media, said platen including a plurality of spaced apart grooves, wherein said grooves are disposed substantially the length of said platen;

evacuating air from said grooves thereby to hold said media against said platen surface; and providing means disposed at one end of said platen for preventing air flow into said grooves at an edge of said platen defined by said platen end.

21. The method according to claim 20, including disposing said spaced apart grooves so that they are substantially parallel.

22. The method according to claim 20, including locating plug means intermediate the ends of said platen for preventing airflow into said grooves from an edge of said platen.

23. The method according to claim 20, including forming a first and a second opening in each one of said grooves and a corresponding first and second opening through the bottom of each of said grooves so that said first openings are aligned in a row perpendicular to said grooves and said second openings are aligned in a row parallel to said first openings row.

24. The method according to claim 20, including using said first row of openings to define on said platen an edge of a first media sheet having a width; and using said second row of openings to define on said platen an edge of a second media sheet having a width greater than that of said first media sheet.

25. The method according to claim 20, including preventing airflow by inserting a plug having a body member and a plurality of tines whereby said tines extend into the aligned first openings in said grooves to prevent airflow from an edge of said platen into said grooves; and preventing airflow further by inserting a plug having a body member and a plurality of tines whereby said tines extend into the aligned second openings in said grooves to prevent airflow from an edge of said platen into said grooves from an area located between said first plugged openings and said second openings.

26. An apparatus for heating media, comprising:

a platen for supporting said media, said platen including a pair of sidewalls depending therefrom;

a pair of end caps, wherein one end cap is connected to the sidewalls at an end thereof and the other end cap is connected to the opposite ends of the sidewalls; and a heating element disposed against the underside of said platen and in contact with each of said sidewalls and said end caps.

27. The apparatus according to claim 26, wherein said platen includes an elongated configuration.

28. The apparatus according to claim 26, wherein said end caps are composed of thermally conductive material.

29. The apparatus according to claim 26, wherein said end caps are selected from the group consisting of copper alloy, aluminum and composites containing carbon fibers.

30. The apparatus according to claim 26, wherein each one of said end caps includes a generally flat inner surface, for contacting said sidewalls, and an arcuate shaped outer surface.

31. The apparatus according to claim 26, wherein each one of said end caps includes an upper portion and a dependent lower portion and said lower portion is narrower than said upper portion in the distance from said inner surface to said arcuate shaped outer surface.

32. An apparatus for drawing media against a member, comprising:

a platen having a surface for supporting media, said platen including a plurality of spaced apart grooves, wherein said grooves are disposed substantially the length of said platen surface;

means for evacuating air from said grooves thereby to hold said print media against said platen surface; and means disposed at one end of said platen for preventing air flow into said grooves at an edge of said platen defined by said platen end.

33. The apparatus according to claim 32, wherein said spaced apart grooves are substantially parallel.

34. The apparatus according to claim 32, wherein said one end of said platen includes a recess for receipt therein of a portion of said preventing means.

35. The apparatus according to claim 32, wherein said preventing means includes a body member and a plurality of tines projecting from said body member wherein said body member fits into said platen recess and said tines fit into said grooves to prevent airflow into said grooves from the edge of said platen.

36. The apparatus according to claim 34, wherein said recess and said body member contain an opening for receipt of means for attaching said member to said platen.

37. An apparatus for drawing media against a platen surface, comprising:

a platen having a surface for supporting media, said platen including a plurality of spaced apart grooves, wherein said grooves are disposed substantially the length of said platen;

means for evacuating air from said grooves thereby to hold said media against said platen surface; and means disposed intermediate the ends of said platen for preventing airflow into said grooves from an edge of said platen.

38. The apparatus according to claim 37, wherein said spaced apart grooves are substantially parallel.

39. The apparatus according to claim 37, wherein each one of said grooves includes a first and a second opening through the bottom of each of said grooves and through said platen and said first openings are aligned in a row perpendicular to said grooves and said second openings are aligned in a row parallel to said first openings row.

40. The apparatus according to claim 37, wherein said first row helps to define on said platen an edge of a first media sheet having a width and said second row helps to define on said platen an edge of a second media sheet having a width greater than that of said first media sheet.

41. The apparatus according to claim 37, wherein said means for preventing airflow includes a plug having a body member and a plurality of tines whereby said plug is attached to the underside of said platen and said tines extend into the aligned first openings in said grooves to prevent airflow from an edge of said platen into said grooves.

42. The apparatus according to claim 37, wherein said means for preventing airflow further includes a plug having a body member and a plurality of tines whereby said plug is attached to the underside of said platen and said tines extend into the aligned second openings in said grooves to prevent airflow from an edge of said platen into said grooves from an area located between said first plugged openings and said second openings.

* * * * *